US006954950B2

(12) United States Patent
Chen

(10) Patent No.: US 6,954,950 B2
(45) Date of Patent: Oct. 18, 2005

(54) FOLDABLE HANGING BED

(76) Inventor: Libin Chen, Qiaoyu Building, Boyi Town, Ximenwai, Changzhou, Jiangsu 213147 (CN)

( * ) Notice: Subject to any disclaimer, the term of this patent is extended or adjusted under 35 U.S.C. 154(b) by 0 days.

(21) Appl. No.: 10/829,889

(22) Filed: Apr. 21, 2004

(65) Prior Publication Data

US 2004/0205893 A1 Oct. 21, 2004

(30) Foreign Application Priority Data

Apr. 21, 2003 (CN) ..... 03221269 U

(51) Int. Cl.[7] ..... A45F 3/24
(52) U.S. Cl. ..... 5/122; 5/129; 5/127
(58) Field of Search ..... 5/120–129; 135/116, 135/90, 121, 143; 297/45, 452.63

(56) References Cited

U.S. PATENT DOCUMENTS 2,581,623 A * 1/1952 Benjamin ..... 5/129
3,783,458 A * 1/1974 Westrich ..... 5/129
5,392,476 A * 2/1995 Williams ..... 5/127
6,665,896 B1 * 12/2003 Tseng ..... 5/121

* cited by examiner

*Primary Examiner*—Heather Shackelford
*Assistant Examiner*—Fredrick Conley
(74) *Attorney, Agent, or Firm*—Martine Penilla & Gencarella, LLP

(57) ABSTRACT

A foldable hanging bed includes a hanging bed fabric, main support tubes, pillar support tubes, pillars tubes, side support tubes, transverse connecting tubes, iron check elements, hanging chain fitting elements, and shoes. The upper portion of each of the main support tubes is connected to a pillar tube, and is provided with an iron check element. At the upper end of the pillar tube is provided a hanging chain or rope fitting element. At the lower ends of the side support tubes are provided shoes. Around the side support tubes are provided sponge sleeves, which are easier for hand operation when the bed is supported or folded. At both ends of the fabric are provided lining tubes, on which the hanging chains or ropes are disposed. The bed fabric is sleeved over the hanging chain or rope fitting elements via the hanging chain or rope.

6 Claims, 5 Drawing Sheets

FOLDABLE HANGING BED

TECHNICAL FIELD

This invention relates to a foldable hanging bed that is suitable for travel and leisure, and outdoor activities in a courtyard, in a park, and at the beach.

BACKGROUND ART

At present, the hanging bed suitable for travel and leisure employs an assembly structure, which cannot be folded all at once. In use, various members need to be assembled one by one and fixed by screws. To fold the conventional hanging bed after use, all the members need to be detached for packaging, and this takes a lot of time and trouble. The members occupy a large space, which is inconvenient for carrying. Thus, the conventional bed cannot keep pace with the modern life of people. In addition, the conventional bed employs a large number of parts, and once any one of them is lost, the bed cannot be fully assembled and will not work properly.

SUMMARY OF THE INVENTION

The present invention provides a foldable hanging bed that overcomes the above-mentioned defects of conventional foldable hanging beds. The foldable hanging bed of the invention employs an assembly-type linkage structure that includes main support tubes, pillar tubes, pillar support tubes, and side support tubes. These support tubes can be folded all at once, thus providing the advantages of easy use, stable structure, safety and reliability, and convenience for carrying.

In one embodiment, the foldable hanging bed includes a hanging bed fabric, two main support tubes, pillar tubes, pillar support tubes, side support tubes, transverse connecting tubes, iron check elements, hanging chain or rope fitting elements, and shoes. The two main support tubes are cross-wise connected, with a sheath being provided at the cross juncture thereof. The upper portion of each of the two main support tubes is connected to one of the pillar tubes, and is provided with an iron check element, which limits the pillar tube to inward rotation when force is exerted on the hanging bed during use. A hanging chain fitting element or a hanging rope fitting element is provided at the upper end of each of the pillar tubes. Both sides of the upper portion of each of the two main support tubes are connected to the side support tubes. Shoes are provided at the lower ends of the side support tubes. A transverse connecting tube is provided at both sides of the lower portion of each of the two main support tubes, and the other end of the transverse connecting tube is connected to the shoes of the side support tubes. The upper end of each of the pillar support tubes is movably connected to one of the pillar tubes, and the lower end of each of the pillar support tubes is connected to one of the shoes of the two main support tubes. Around the side support tubes are provided sponge sleeves, which are easier for hand operation when the bed is supported or folded. Lining tubes are provided at both ends of the fabric, and the hanging chains or ropes are disposed on the lining tubes. The bed fabric is sleeved over the hanging chain or rope fitting elements by a hanging chain or rope. Each iron check element includes main support tube fitting holes and pillar tube check grooves, with the main support tubes being fixed in the main support tube fitting holes.

To use the foldable hanging bed, one just holds with both hands the sponge sleeves around the support tubes at one side of the foldable hanging bed, and pulls apart the main support tubes and side support tubes. The pillar support tubes will unfold the pillar tubes, and then the hanging chains or hanging ropes fitted on the hanging chain or hanging rope fitting elements at the upper ends of the pillar tubes will unfold the bed fabric and suspend it on the upper portions of the pillar tubes. Thus, one can sleep and lie on the hanging bed. To fold the foldable hanging bed, one just holds with both hands the sponge sleeves on the support tubes at one side of the bed, and pushes forcibly inward. The main support tubes and the pillar support tubes will collapse into a folded position, and the pillar tubes will be folded together with the bed fabric in a bunch. The bed can then be put into a bag for carrying.

The foldable hanging bed is reasonably designed, has an elegant appearance, and a stable structure. It is safe and reliable, convenient to use, and comfortable on which to lie and sleep. The bed can swing freely, can be folded all at once, and has a small volume after being folded, and hence is convenient to carry. As such, the foldable hanging bed can be widely applied to leisure and travel.

DETAILED DESCRIPTION OF THE INVENTION

Specific embodiments the folding hanging bed according to this invention will be discussed in conjunction with the drawings.

Figure 1:
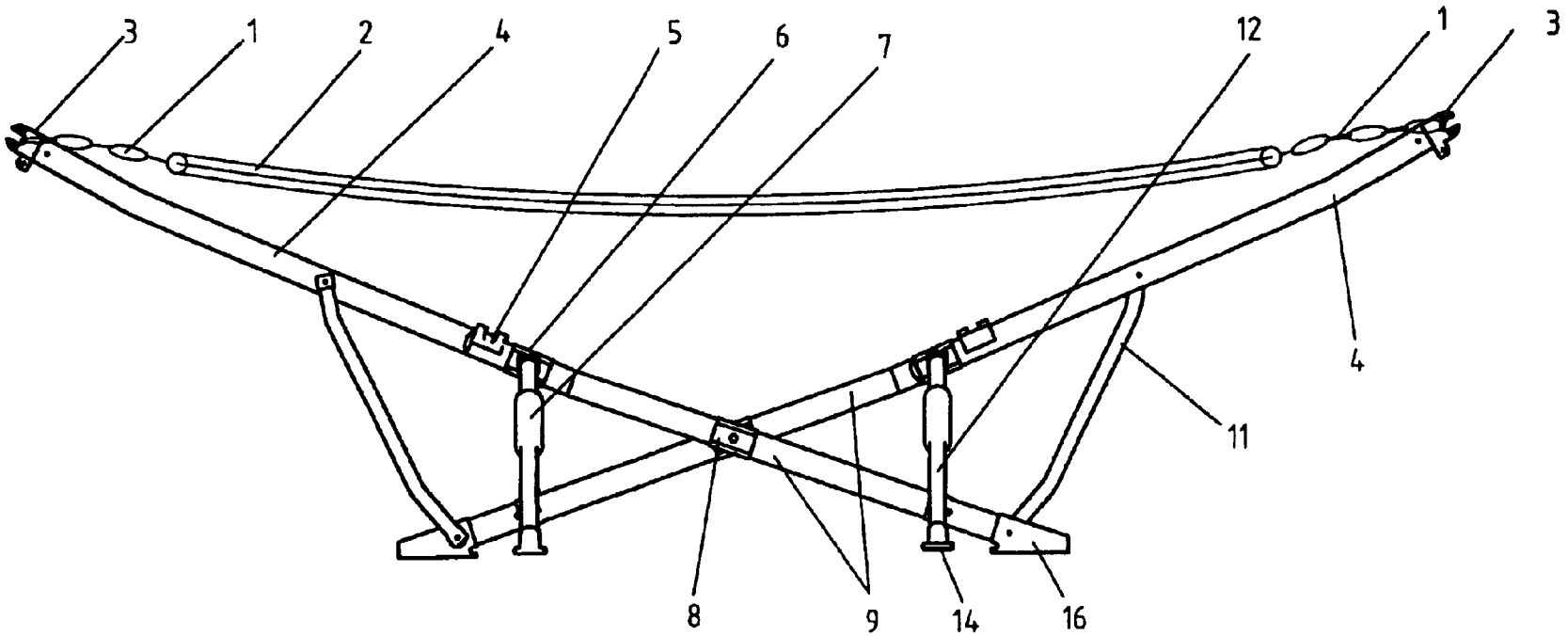
FIG. 1 is a front view of the structure of the foldable hanging bed according to one embodiment of this invention.
Figure 2:
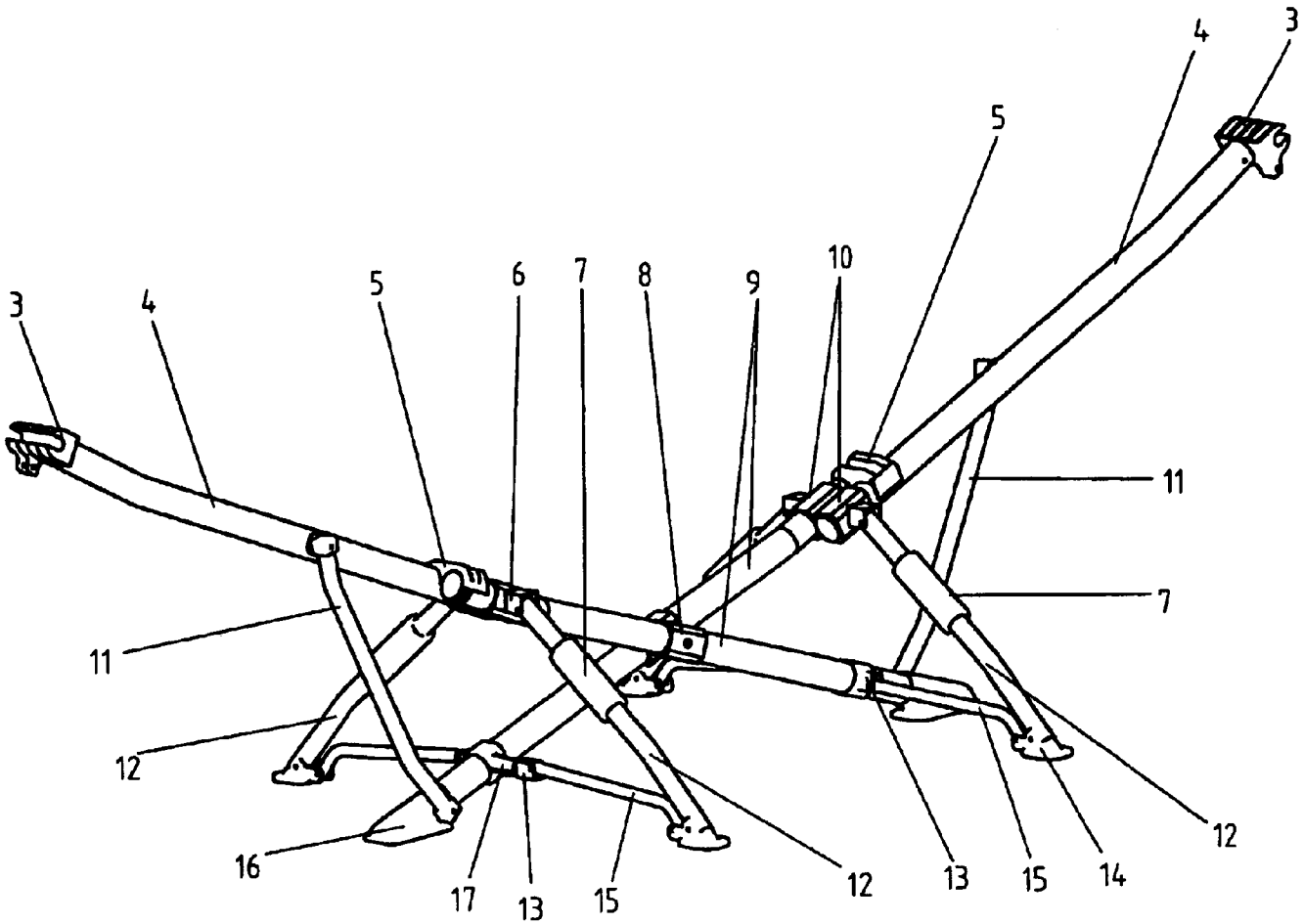
FIG. 2 is a schematic view of the support structure of the foldable hanging bed according to this invention.
Figure 4:
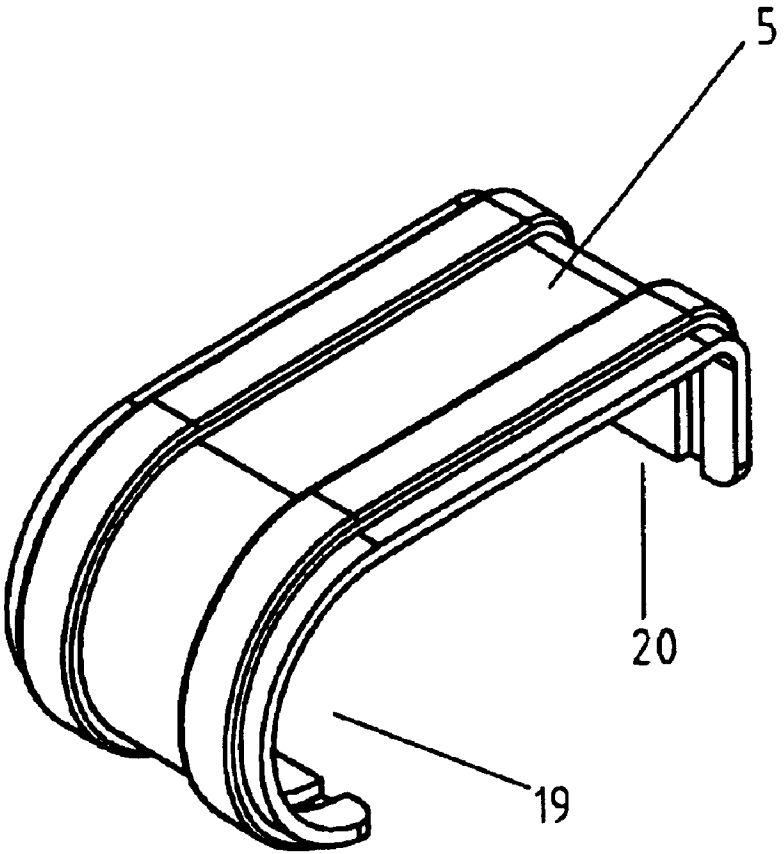
FIG. 4 is a schematic view of the iron check element of the foldable hanging bed according to this invention.
Figure 5:
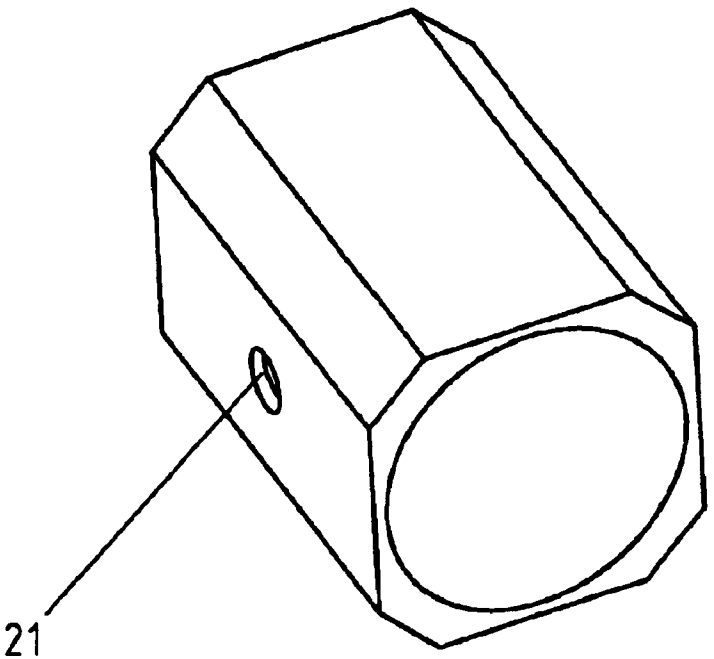
FIG. 5 is a schematic view of the sheath of the folding hanging bed according to this invention.

Referring to FIGS. 1 and 2, the foldable hanging bed of this invention includes hanging chains 1, hanging bed fabric 2, main support tubes 9, pillar support tubes 11, pillar tubes 4, side support tubes 12, transverse connecting tubes 15, iron check element 5, hanging chain or rope fitting element 3, and shoes. The two main support tubes 9 are cross-wise connected together to form a hinged connection, and at the cross juncture a sheath 8 is provided, into which the two main support tubes are inserted. A pillar tube 4 is connected at the upper portion of the main support tube 9 (see FIG. 2). The upper portions of the main support tube 9 and pillar tube 4 are sleeved with sheaths 10, to the structure of which is shown in FIG. 5. A pivot (not shown) passes through the pivoting hole 21 of the two sheaths 10 and is connected to the main support tube 9 and pillar tube 4, and the other side of the sheath 10 is connected to a U-shaped hinge 6. An iron check element 5 is snap fit to the main support tube 9 and pillar tube 4 for limiting the pillar tube 4 to inward rotation when force is exerted on the hanging bed during use. FIG. 4 shows the structure of the iron check element 5, which includes main support tube fitting hole 19 and pillar tube check groove 20, with the main support tube being welded into the main support tube fitting hole 19.

At the lower end of the main support tube 9, main support tube shoe 16 is provided, and at the upper end of pillar tube 4 hanging chain fitting element or hanging rope fitting element 3 is provided. Side support tubes 12 are connected at both sides of the upper portions of the main support tubes 9 via U-shaped hinges 6, which are fixed on the sheath 10 to form a pivoting connection. The lower end of the side support tube 12 is provided with side support tube shoe 14. Transverse connecting tube 15 is provided at both sides of the lower portions of the main support tube 9 via transverse connecting tube fitting element 17 and U-shaped hinge 13, and the transverse connecting tube 15 is pivoted to the lower portion of the main support tube 9. The other end of the transverse connecting tube 15 is connected to the shoe 14 of the side support tube 12, and on the shoe of the side support tube 12 a pivoting hole is provided. The upper end of the pillar support tube 11 is movably connected to the pillar tube 4, and the lower end of the pillar support tube 11 is connected to the shoe 16 of the main support tube 9, on which is provided a pivoting hole. On the side support tube 12 is provided a sponge sleeve 7, which is designed for easier hand operation when the bed is supported and folded. Both ends of the bed fabric 2 are provided with lining tubes 18, with hanging chain 1 or hanging rope being provided thereon. The bed fabric 2 is sleeved over the hanging chain or rope fitting element 3.

Figure 3:
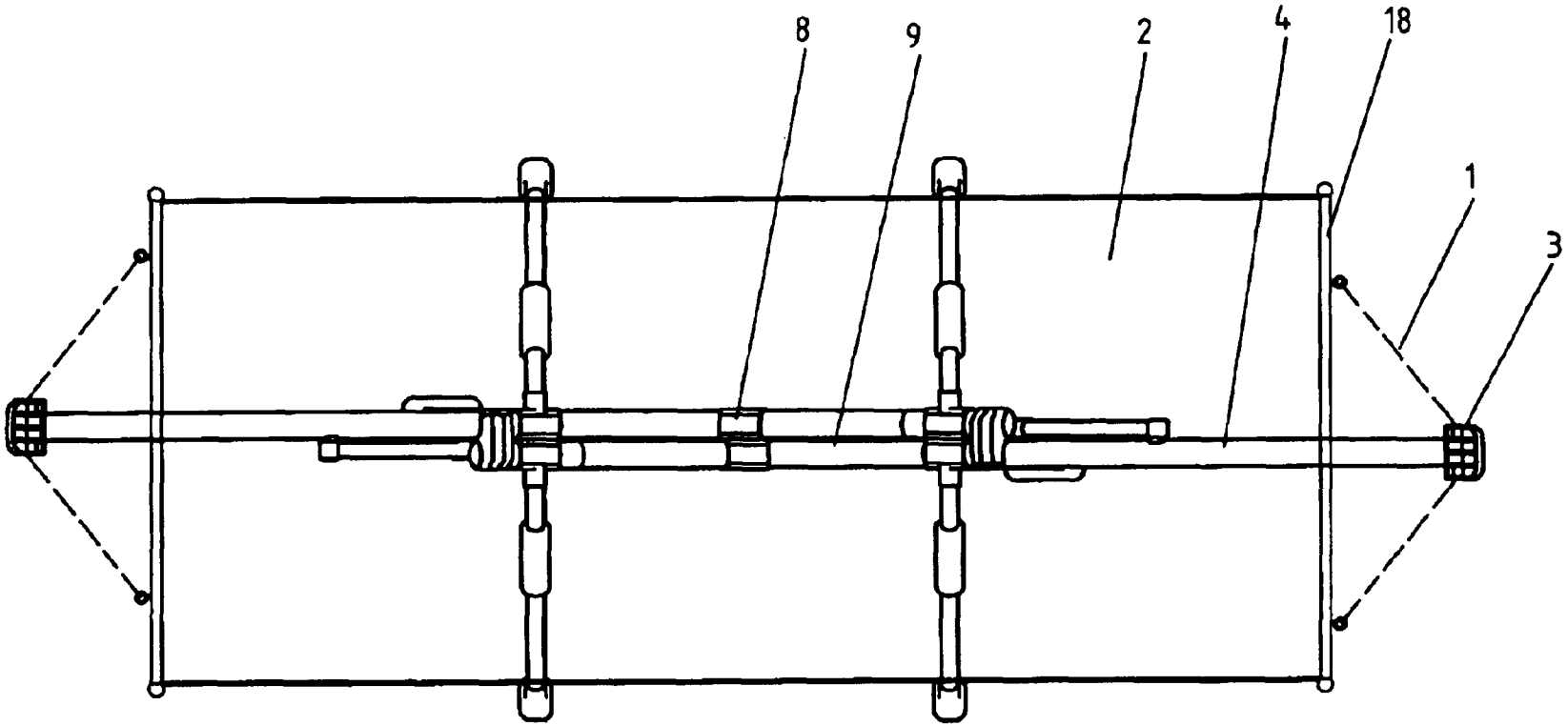
FIG. 3 is a plan view of the structure of the foldable hanging bed according to this invention.

As shown in FIG. 3, each end of the hanging bed fabric 2 is provided with a lining tube 18, on which the hanging chain or rope is provided. The length of the lining tube 18 is slightly greater than the width of the fabric 2.

The invention has been described herein in terms of several exemplary embodiments. Other embodiments of the invention will be apparent to those skilled in the art from consideration of the specification and practice of the invention. The embodiments and preferred features described above should be considered exemplary, with the invention being defined by the appended claims and equivalents thereof.

What is claimed is:

1. A foldable hanging bed, comprising:

a hanging bed fabric, two main support tubes, pillar support tubes, pillar tubes, side support tubes, transverse connecting tubes, iron check elements, hanging chain or rope fitting elements, and shoes, wherein said two main support tubes are cross-wise connected, with a sheath being provided at a cross juncture thereof, an upper portion of each of said two main support tubes is connected to one of said pillar tubes, and is provided with an iron check element, an upper end of each of said pillar tubes is provided with a hanging chain fitting element or a hanging rope fitting element, side support tubes are provided at both sides of the upper portion of each of said two main support tubes, shoes are provided at lower ends of said two main support tubes and said side support tubes, a transverse connecting tube is provided at both sides of a lower portion of each of said two main support tubes, and an other end of each transverse connecting tube is connected to one of said shoes of said side support tubes, an upper end of each of said pillar support tubes is movably connected to one of said pillar tubes, and a lower end of each of said pillar support tubes is connected to one of said shoes of said two main support tubes, and said bed fabric is sleeved over said hanging chain or rope fitting element via said hanging chain or rope.

2. The foldable hanging bed according to claim 1, wherein each of two ends of said hanging bed fabric is provided with a lining tube, on which said hanging chain or rope is provided.

3. The foldable hanging bed according to claim 1, wherein each of said iron check elements includes main support tube fitting holes and pillar tube check grooves, with said two main support tubes being welded into said main support tube fitting holes.

4. The foldable hanging bed according to claim 1, wherein each of said side support tubes is provided with a sponge sleeve.

5. The foldable hanging bed according to claim 1, wherein said transverse connecting tube at both sides of the lower portion of each of said two main support tubes is provided via a transverse connection fixing element and a U-shaped hinge.

6. The foldable hanging bed according to claim 1, wherein both sides of the upper portion of each of said two main support tubes are connected to one of said side support tubes via a U-shaped hinge.

* * * * *